US008864419B2

(12) United States Patent
Broughton et al.

(10) Patent No.: US 8,864,419 B2
(45) Date of Patent: Oct. 21, 2014

(54) FOUNDATION SUPPORT SYSTEM FOR AN OFFSHORE WIND ENERGY CONVERTOR, CORRESPONDING TO AN OFFSHORE WIND POWER GENERATING FACILITY

(75) Inventors: Peter Broughton, Camberley (GB); Richard Davies, Oakley (GB); Peter Martin, Glasgow (GB); Michel Hamon, Paris (FR); Nicolas Parsloe, Paris (FR)

(73) Assignees: Peter Broughton, Surrey (GB); Richard Davies, Basingstoke (GB); Marine Engineering Energy Solutions, Ltd., West Sussex (GB)

( * ) Notice: Subject to any disclaimer, the term of this patent is extended or adjusted under 35 U.S.C. 154(b) by 0 days.

(21) Appl. No.: 13/276,214

(22) Filed: Oct. 18, 2011

(65) Prior Publication Data

US 2012/0093589 A1 Apr. 19, 2012

(30) Foreign Application Priority Data

Oct. 18, 2010 (FR) ..... 10 58458

(51) Int. Cl.
*E02B 17/00* (2006.01)
*E02D 27/42* (2006.01)

(52) U.S. Cl.
CPC ..... *E02D 27/42* (2013.01)
USPC ..... 405/202; 405/204; 405/224

(58) Field of Classification Search
USPC ..... 405/195.1, 202, 203, 204, 205, 207, 405/224
See application file for complete search history.

(56) References Cited

U.S. PATENT DOCUMENTS

| | | | | | |
|---|---|---|---|---|---|
| 3,524,323 | A | * | 8/1970 | Miller | 405/202 |
| 3,636,716 | A | * | 1/1972 | Castellanos | 405/202 |
| 3,667,239 | A | * | 6/1972 | Mott | 405/202 |
| 3,708,985 | A | * | 1/1973 | Pogonowski et al. | 405/202 |
| 3,720,066 | A | * | 3/1973 | Vilain | 405/202 |
| 4,126,010 | A | * | 11/1978 | Michel et al. | 405/202 |
| 4,137,722 | A | * | 2/1979 | Mossiossian et al. | 405/202 |
| 4,175,890 | A | * | 11/1979 | Taylor | 405/202 |
| 4,222,682 | A | * | 9/1980 | Vilain | 405/203 |
| 4,227,830 | A | * | 10/1980 | Tuson | 405/195.1 |
| 4,231,681 | A | * | 11/1980 | Tuson | 405/195.1 |

(Continued)

FOREIGN PATENT DOCUMENTS

| | | |
|---|---|---|
| EP | 2065593 | 6/2009 |
| GB | 2394498 | 4/2004 |

(Continued)

OTHER PUBLICATIONS

European Search Report dated Feb. 21, 2012 of the corresponding European Patent Application No. 11306345.7.

(Continued)

*Primary Examiner* — Frederick L Lagman
(74) *Attorney, Agent, or Firm* — Christie, Parker & Hale, LLP

(57) ABSTRACT

A foundation system for supporting an offshore wind energy convertor is provided and includes a foundation base resting on the seabed and a column supporting the wind energy convertor which is linked to the foundation base. The column and the base are linked by an articulated joint connection, allowing tilt motions of the column in all directions from a vertical axis. A wind power generator facility including such a support, and a method of erecting such a foundation system, are also provided.

13 Claims, 5 Drawing Sheets

(56) References Cited

U.S. PATENT DOCUMENTS

| | | | | |
|---|---|---|---|---|
| 4,231,682 | A * | 11/1980 | Tuson | 405/202 |
| 4,253,780 | A * | 3/1981 | Lecomte et al. | 405/202 |
| 4,266,499 | A * | 5/1981 | Tam | 405/224 |
| 4,268,191 | A * | 5/1981 | Tuson | 405/195.1 |
| 4,273,470 | A * | 6/1981 | Blomsma et al. | 405/202 |
| 4,284,367 | A * | 8/1981 | Tuson et al. | 405/202 |
| 4,432,668 | A * | 2/1984 | Rank | 405/202 |
| 4,741,647 | A * | 5/1988 | Dumazy et al. | 405/224.4 |
| 4,797,033 | A * | 1/1989 | Pollack | 405/202 |
| 4,813,815 | A * | 3/1989 | McGehee | 405/202 |
| 5,044,450 | A * | 9/1991 | Aso et al. | 405/202 |
| 7,156,037 | B2 * | 1/2007 | Borgen | 114/264 |
| 7,296,971 | B2 * | 11/2007 | Borgen | 416/85 |
| 7,819,073 | B2 * | 10/2010 | Sveen et al. | 405/224 |
| 8,192,160 | B2 * | 6/2012 | Garcia Lopez et al. | 416/1 |
| 2003/0182741 | A1 * | 10/2003 | Prins | 14/71.1 |
| 2004/0169376 | A1 * | 9/2004 | Ruer et al. | 290/55 |
| 2007/0212209 | A1 * | 9/2007 | Borgen | 415/1 |
| 2010/0150665 | A1 * | 6/2010 | Karal | 405/232 |
| 2010/0219645 | A1 * | 9/2010 | Yamamoto et al. | 405/224 |
| 2012/0045345 | A1 * | 2/2012 | Horton et al. | 416/244 R |
| 2012/0155967 | A1 * | 6/2012 | Nagurny et al. | 405/224 |
| 2012/0189390 | A1 * | 7/2012 | Belinsky et al. | 405/224 |
| 2012/0201608 | A1 * | 8/2012 | Belinsky et al. | 405/224 |

FOREIGN PATENT DOCUMENTS

| | | |
|---|---|---|
| GB | 2460172 | 11/2009 |
| JP | 57-127022 | 8/1982 |
| WO | WO 03/098038 A1 | 11/2003 |

OTHER PUBLICATIONS

K. R. Drake, "An investigation into the use of an articulated column supported wind turbine in water depths of 60-120 metres", The Royal Institution of Naval Architects, 2010, 8 pages, Marine Renewable and Offshore Wind Energy, London, UK.

French Search Report dated Oct. 18, 2010 for corresponding French application No. FR1058458, 4 pages.

* cited by examiner

FOUNDATION SUPPORT SYSTEM FOR AN OFFSHORE WIND ENERGY CONVERTOR, CORRESPONDING TO AN OFFSHORE WIND POWER GENERATING FACILITY

CROSS-REFERENCE TO RELATED APPLICATION

This application claims priority of French application no. 1058458, filed in the Insitut National de la Propiete Industrielle on Oct. 18, 2010, said French application being incorporated by reference herein in its entirety.

FIELD OF THE INVENTION

The current invention relates to a foundation system for supporting an offshore wind energy convertor, including a foundation base resting on the seabed and a column supporting the wind energy convertor, linked to the foundation base.

BACKGROUND TO THE INVENTION

Different types of foundation systems have been developed so as to support offshore wind energy convertors, such as gravity base foundations, whose on-bottom stability is simply due to their own weight on the seabed; monopile type foundations, in which a steel column is embedded several meters into the seabed, tripod-type foundations comprising one column and at least three support legs embedded into the seabed, and jacket type foundations, which are steel towers made of braced members.

These structures are fitted to support wind energy convertors in moderately deep waters, for water depth greater than approximately 40 meters. However, the size of these structures significantly increases with the water depth, and so does the cost of fabrication, transport, and installation since these structures have to be massive and strong enough to resist forces generated by current, waves, and wind.

Floating platforms are well known for the installation of wind turbines in deeper water depth, which comprise one or several columns submerged by about 100 meters but not resting on the seabed. These floating platforms are expensive and typically require water depth beyond 200 meters.

The present invention provides a foundation support system for an offshore wind energy convertor, and is designed to have a low cost and good resistance to the forces generated by current, waves, and wind.

In this regard, the invention is characterized by the fact that the column and foundation base are linked by an articulated joint connection, i.e., any type of connection that allows the column to tilt with respect to the foundation base in any direction from a vertical axis.

Depending on the method of construction, the system may present one or several of the following features, separately or following all possible technical combinations:

- the system comprises mooring lines, equipped with dead weight, linking the column to the seabed;
- the column comprises in its upper part at least one tight, internal compartment;
- the column comprises in its upper part at least two independent tight, internal compartments;
- at least one internal compartment may be partially emerging when the column axis is nearly vertical;
- the column comprises in its upper part, near the sea surface, a cross section larger than in its lower part;
- the system comprises at least one buoyancy caisson, fixed to the column;

- the foundation base is equipped with at least one buoyancy caisson, which can be ballasted;
- the column comprises a steel lattice structure;
- the column comprises at its top a recess suited to house the lower part of the wind energy convertor, and allows the wind energy convertor to slide inside the column; and
- the column is connected to the base through an articulated joint.

The present invention also provides a complete wind power generator facility, which comprises a wind power generator unit and the foundation support system.

The present invention also provides a process of fabrication, transport, and installation of a wind energy convertor facility, which comprises the following stages:

- construction of a wind energy convertor and a foundation system to support it, the system comprising a foundation base resting on the seabed and a column supporting the wind energy convertor, the column and the foundation base being linked by a articulated joint connection that allows for tilting motions of the column with respect to the foundation base in any direction with respect to a vertical axis;
- transport of the foundation support system to a wind farm location;
- lowering the foundation support system down to the seabed by ballasting the foundation support system;
- installing the wind energy convertor onto the foundation support system after the foundation system is lowered down to the seabed, using a crane vessel moored to the foundation system.

SUMMARY OF THE INVENTION

According to a first aspect of the invention, there is provided a foundation support for a offshore wind energy convertor, suitable for placement on a seabed, of a type including a base and a column for supporting a wind energy convertor connected to the base, wherein the column and the base are linked by an articulated joint connection, allowing tilt motions of the column in all directions from a vertical axis.

The articulated joint connection may include a universal joint.

The universal joint may be a cardan type.

The foundation support may be fitted with mooring lines equipped with clump weights allowing the connection of the column to the seabed.

The column may comprise, in its upper part, at least one watertight internal compartment. The column may comprise, in its upper part, at least two watertight internal compartments.

The at least one inner compartment may be partially immersed when the axis of the column is substantially aligned with the vertical axis.

The column may present in its upper part near a surface of water, a cross section larger than in its lower part.

The foundation support may include at least one buoyancy caisson attached to the column.

The base may be equipped with at least one buoyancy caisson, which can be ballasted.

The column may include a steel lattice structure.

The column may include at its top end a recess which can house the lower part of a mast of a wind energy convertor, allowing a sliding motion of the mast of the wind energy convertor inside the column.

According to a second aspect of the invention, there is provided an offshore wind power generator facility comprising a wind energy converter and a foundation support according to a first aspect of the present invention.

According to a third aspect of the invention, there is provided an offshore wind power generator facility comprising a wind energy converter and a foundation support, the foundation support comprising a base and a column for supporting the wind energy convertor and connected to the base, wherein the column and the base are linked by an articulated joint connection, allowing tilt motions of the column in all directions from a vertical axis.

According to a fourth aspect of the invention, there is provided a method for mounting an offshore wind energy converter comprising the steps of mounting a support base on the seabed; mounting a support column through an articulated joint to the base; and mounting a wind energy converter to the support column. The articulated joint may be a universal joint.

BRIEF DESCRIPTION OF THE DRAWINGS

Embodiments of the present invention will now be described, by way of example only, with reference to the following drawings, in which.

DETAILED DESCRIPTION

Figure 1:
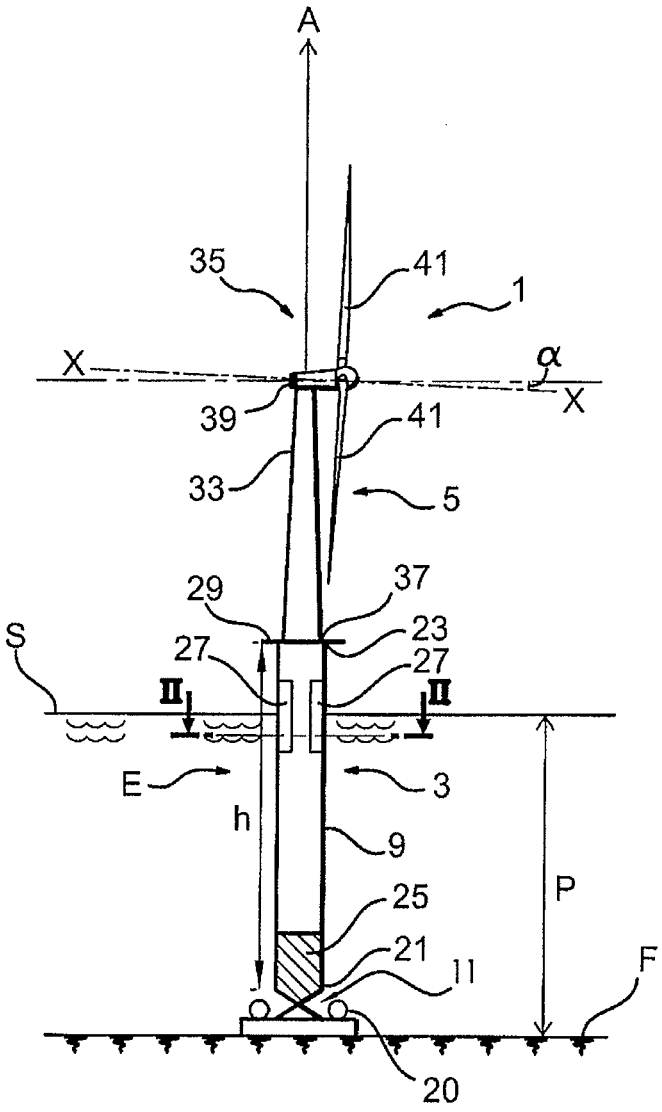
FIG. 1 illustrates an offshore wind energy convertor facility, generally referred to as 1, according to a first embodiment of the present invention.

FIG. 1 illustrates an offshore wind energy convertor facility, installed on the seabed F at a depth P from the sea surface S. The facility 1 includes the foundation system 3 for supporting a wind energy convertor, installed on the seabed F, and the wind energy convertor 5, attached to the top end of the system 3.

The foundation system 3 consists of a support base 7, resting on the seabed F, a support column 9, and a articulated joint 11 connecting the base 7 and the column 9. The base 7 rests on the seabed F, is fixed to the articulated joint 11, and can be ballasted. The base 7 also comprises buoyancy caissons 20, located and sized in order to ensure the floatation and the marine stability of the structure 3 when towing it to the wind farm operating site. The buoyancy caissons also ensure the marine stability of the structure 3 during its lowering down to the seabed F.

The base 7 can be made, for example, of prestressed reinforced concrete or of steel, or of a steel-concrete composite structure consisting of two concentric steel shells, with concrete poured in between.

Figure 2:
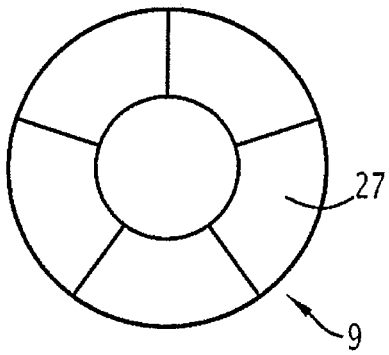
FIG. 2 is a cross-section along line II-II of FIG. 1.

The column 9 is of cylindrical shape and its lower 21 and upper 23 ends are both closed. The column 9 contains, in its lower part, solid ballast 25, for instance concrete, or liquid ballast 25. In its upper part, the column 9 is fitted with several independent tight inner compartments, as illustrated in FIG. 2. These compartments 27 are not totally submerged and prevent the column from becoming completely water filled in the case where a collision between a ship and the facility would induce flooding of those compartments.

At its upper end 23, the column 9 is also fitted with a ring access platform 29, enabling staff to access the wind energy convertor 5. The height h of the column 9 is such that the top of the column 23 is positioned above the water sea surface S, and the access platform 29 remains beyond the reach of the highest waves, whatever the inclination of the column 9 is with respect to a vertical axis A in a situation of maximum storm.

The column 9 can be made, for example, of prestressed/reinforced concrete, or of steel, or of a steel-concrete composite structure consisting of two concentric steel shells with concrete poured in between. As an alternative, part of the column can consist of a truss structure.

The lower end 21 of the column 9 is connected to the base 7 through the articulated joint 11, and the base of the wind energy convertor is fixed to the upper end 23.

The articulated joint 11 connects the column 9 with the base 7, while allowing all inclination motions of the column 9 with respect to the base 7, thus with respect to the seabed F, in any direction from the vertical axis A.

Figure 3:
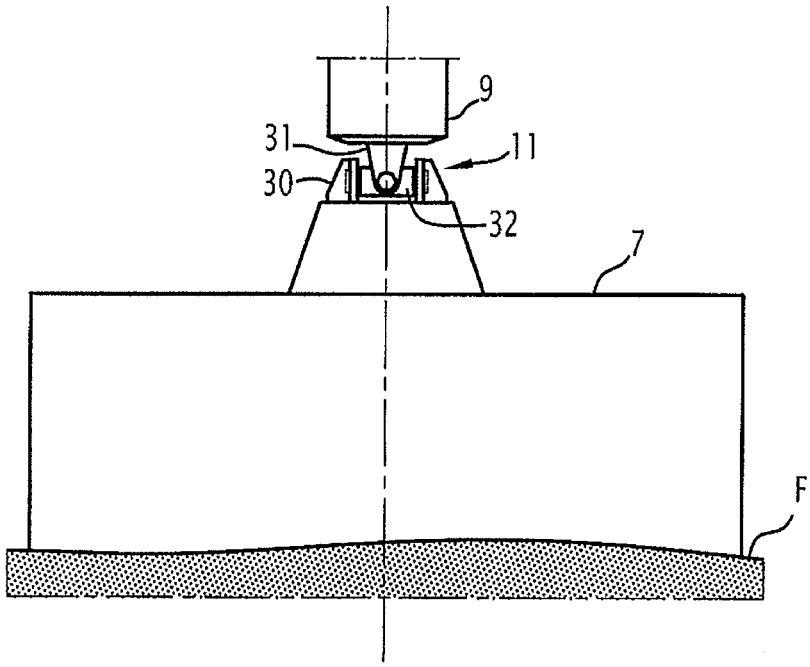
FIG. 3 is a close-up view showing additional detail of the articulation joint shown in FIG. 1.
Figure 4:
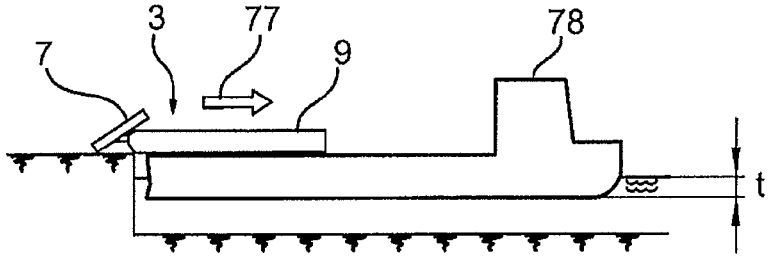
FIGS. 4 to 7 depict the stages of construction and installation of the facility shown in FIG. 1.

As illustrated in FIG. 3, the articulated joint 11 is, for example, a cardan type joint comprising a first yoke 30 fixed on the upper surface of the base 7, and a second yoke 31 fixed on the lower end of the column 9. These two yokes are connected together by a bracing 32 so that their respective planes are perpendicular when the axis of the column 9 is vertical.

The wind energy convertor 5, which is located entirely above the surface S of the water E, includes a mast 33 and a system 35 for producing electricity from wind energy.

The mast 33 has a substantially tapered shape converging upwards. Its lower end 37 is fixed onto the top 23 of column 9, and its vertical axis is aligned with the vertical axis of the column 9.

The system 35 for producing electrical energy comprises an electrical generator 39, in which a rotor is rotated by the blades 41 set in motion by the wind, as is well known.

The blades 41 are sized according to the electrical power required. The mast 33 is sized in length so that the blades 41 can rotate above the access platform 29, at a minimum distance of several meters above the platform.

In calm weather, which means in the absence of wind, ocean current, and waves, the facility 1 is subjected to very small external forces. Under these conditions, the vertical axis of the column 9 is substantially aligned with the vertical axis A, i.e., perpendicular to the seabed F.

In the presence of wind, ocean current, and/or waves, the facility 1 is subject to forces tending to tilt the column 9 with respect to the vertical axis A. The articulated joint between the base 7 and the column 9 then allows the latter one to tilt relatively to the vertical axis A in the direction of the resultant forces exerted on the facility 1, the base remaining fixed onto the seabed F.

The column 9 is then subject to restoring forces, which tend to oppose the inclination, and which are due to the buoyancy of the column 9 and to a hydrostatic restoring force. The buoyancy of the column 9 is enhanced by the air contained in the compartments 27 and the rest of the column, and the buoyancy exerted on the column 9 increases as the column gets more inclined, so submerged. Furthermore, the hydrostatic restoring force exerted on the column, which depends on the displacement of the column, its water plane inertia, and the relative position of the center of buoyancy of the column with respect to its center of mass, increases as the column gets more inclined.

Under the effect of the forces exerted by ocean current, waves, and wind, and of the restoring forces, the column 9 is oscillating around an equilibrium position. If wind, ocean current, and waves stop, the axis of the column 9 re-aligns with the vertical axis A, as a result of restoring force.

We will now explain, with reference to FIGS. 4 to 7, the successive steps of a method of construction and installation of the facility 1.

In the first step of construction, the foundation support 3 and the wind power energy convertor unit 5 are built separately. The base 7 and the column 9 are built and jointed together by means of the articulated joint 11, for instance in a dry dock or on a quay. A solid or liquid ballast 25 can be inserted in column 9 during this construction step.

Once assembled, the foundation support 3 is set afloat, its floatation being ensured by the volume of air contained in the compartments 27 of the column 9 and of the remainder of the column, as well as by the buoyancy caissons 20 of the base 7. After that, in a loading step illustrated in FIG. 4, the foundation support 3 is loaded 77 horizontally onto a submersible vessel 78, then it is transported to the final operation site.

Figure 5:
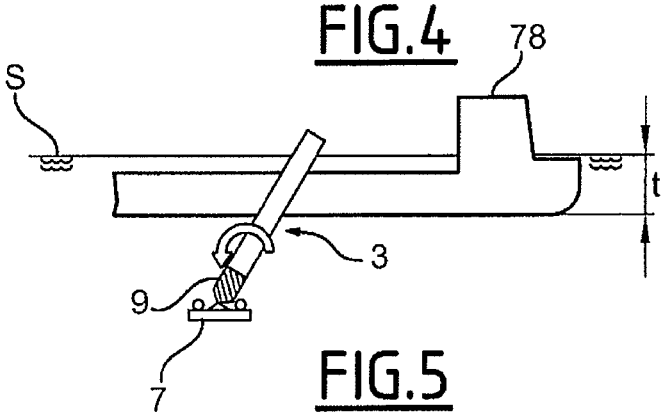
Figure 6:
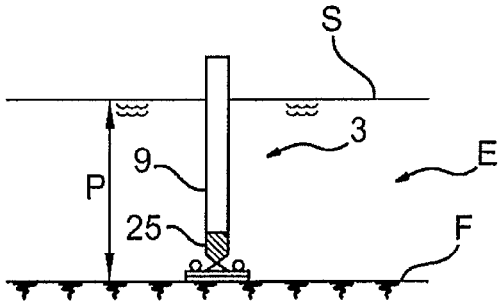

In a float-out step illustrated in FIG. 5, the draft of the vessel 78 is increased by water ballasting, so that the foundation support 3 is at least partially immersed and then gradually upended in a vertical position by ballasting. The ballasting continues until the base 7 is installed on the seabed F. The position of the foundation support 3 at the end of this step is shown in FIG. 6.

Figure 7:
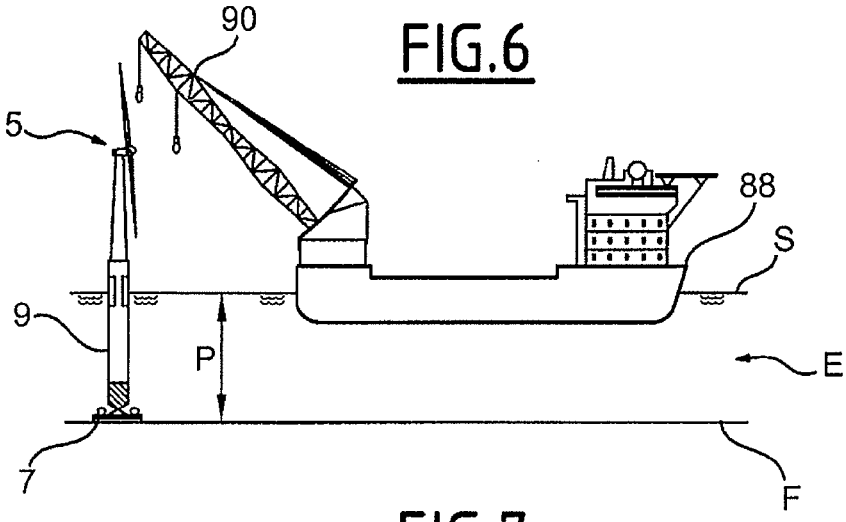

Then, in a step illustrated in FIG. 7, the wind energy convertor 5 is fixed onto the foundation support 3. The self-elevating platforms, typically used for offshore works, are not adapted for water depth exceeding 50 meters. In such cases, as shown, the installation is performed using a vessel 88 equipped with a crane 90, also called a crane vessel.

In the presence of ocean current or waves, the position of the crane vessel 88 is not fixed compared to the foundation support 3, which complicates the installation of the wind energy convector. In order to sort out this problem, the crane vessel 88 is docked to the column 9, which operation is made possible by the fact that the column 9 is able to tilt in all directions relative to the vertical axis A, and therefore to follow the crane vessel motions induced by ocean current or waves. This docking allows one to minimize relative motions between the column 9 and the crane vessel 88.

The wind energy convertor 5 is lifted by the crane 90 on top of the column 9, and then fixed to the top end 23 of the column 9. The crane vessel 88 is then undocked from the column 9, as shown in FIG. 7.

The structure of the offshore wind power generator facility 1, and more particularly the foundation support 3, provides a high resistance to environmental conditions, while facilitating both construction and installation.

The articulated joint between the column 9 and the base 7 of the foundation support 3 actually enables one not only to improve robustness to waves, current, or wind, but also facilitate the installation of the system. Indeed, this articulated joint connection allows the column 9 to tilt from the vertical axis A, so that forces and moments induced on the column 9 and the wind energy convertor 5 by wind, waves, and current are significantly reduced. This inclination is, however, controlled, due to the restoring force exerted on the column 9 when tilting.

Moreover, since the column 9 is allowed to tilt freely, it is possible to moor the column 9 to a crane vessel.

In addition, the independence of the compartments 27 from the column 9 prevents a complete flooding of the column 9, in case the wall of the column is damaged and cracked open, for instance, after a collision with a ship.

Figure 8:
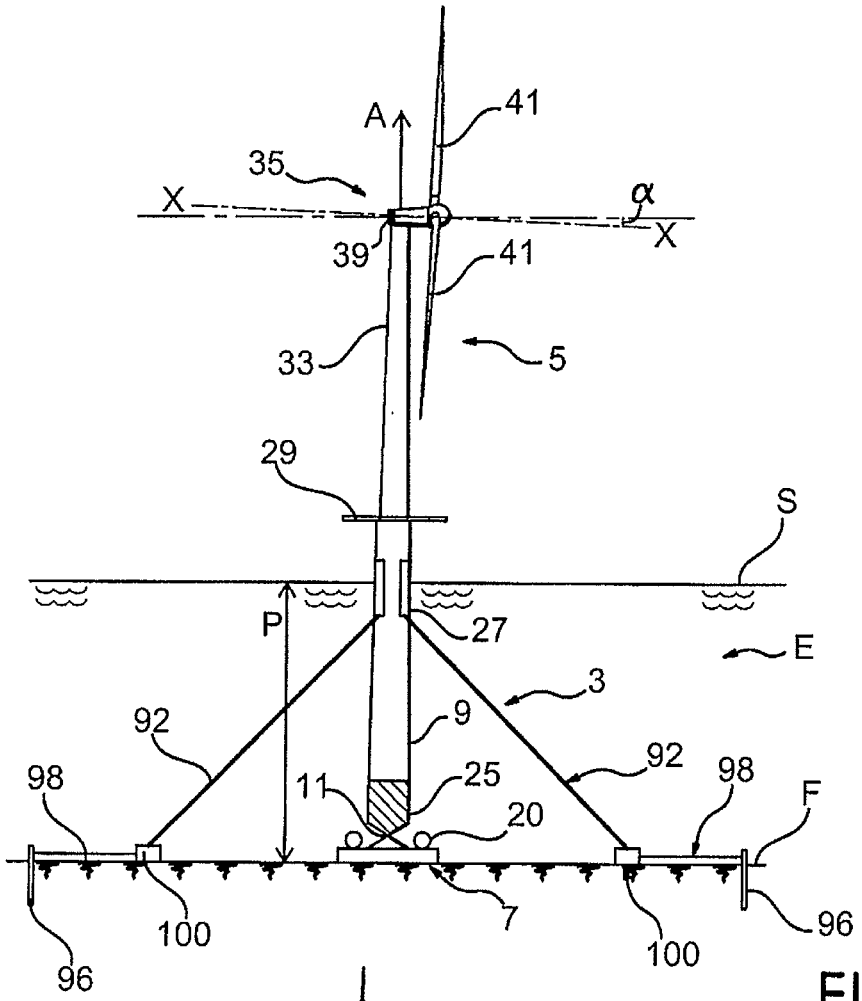
FIG. 8 is a side view of an offshore wind energy convertor facility according to a second embodiment of the present invention.

FIG. 8 illustrates another method of construction and installation of the offshore wind power generator facility. In this Fig., elements that are identical to those represented in FIG. 1 are given the same numbers.

The facility of FIG. 8 differs from the facility 1 described with reference to FIG. 1 in the way that it is fitted with mooring lines 92 connecting the column 9 to the seabed. Each of these mooring lines 92 is anchored at one end to the seabed F, and fixed at the other end to the column 9, close to the surface S of the water.

Anchoring of each mooring line 92 to the seabed is carried out as follows. The line 92 is attached at its lower end to clump weights 100, laid down on the seabed. Furthermore, each clump weight 100 is fixed to one end of an anchor chain 98, the other end of which is fixed onto a pile 96 embedded into the seabed, so that the mooring line 92 and the anchor chain 98 are approximately in the same vertical plane.

The number of mooring lines 92 is, for instance, three or four, and the lines are arranged at an angle of 120° or 90° from one another. These lines enable an increase in the restoring forces exerted on column 9 when it deviates from its vertical position, therefore reducing the amplitude of the tilt motions of the column 9, while providing enough flexibility through the possibility of lifting weights 100 and allowing for the necessary tilt of the column to reduce the forces and moments induced by wind, waves, and current.

In order to improve safety and to facilitate maintenance operations, the lines 92 may be also doubled, having every weight 100 fixed on two lines 92. The lines 92 are made, for example, of steel.

Construction and installation process of the facility illustrated in FIG. 8 include the same steps as described through FIGS. 4 to 7, complemented by a step where the column 9 is anchored to the seabed. At this stage, each mooring line 92 is attached to one end of a concrete block 100. Each concrete block is then put down through the water and anchored to the seabed F by means of a pile 96 and an anchor chain 98.

The tension in each mooring line 92 is adjusted, and each line 92 is then fixed onto the column 9 by means of locking devices.

Figure 9:
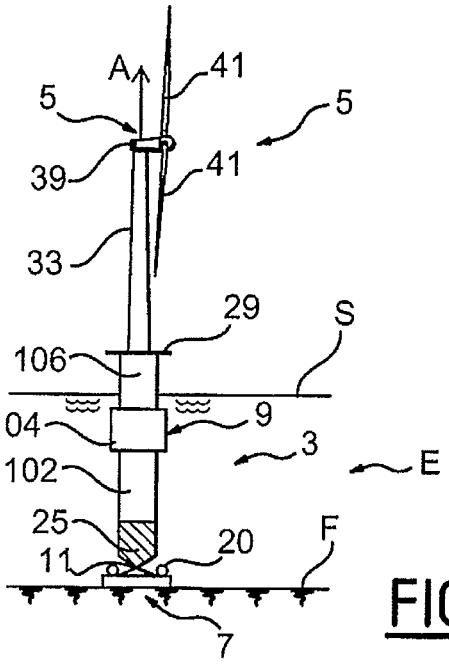
FIG. 9 is a side view of a wind energy convertor facility according to a third embodiment of the present invention.

Other methods of construction and installation of the offshore wind power generator facility as per the invention can be envisaged. In particular, the column 9 is not necessarily of cylindrical shape, and may be of conical or polygonal shape. As shown in FIG. 9, the column can be built from several segments 102, 104, and 106 of different length and cross section, fixed together. Such a structure enables an improvement in hydrodynamic behavior of the column 9 and minimized tilt motions. For instance, increasing the column cross section near the sea surface allows for increasing the restoring hydrostatic force exerted on this column.

Figure 10:
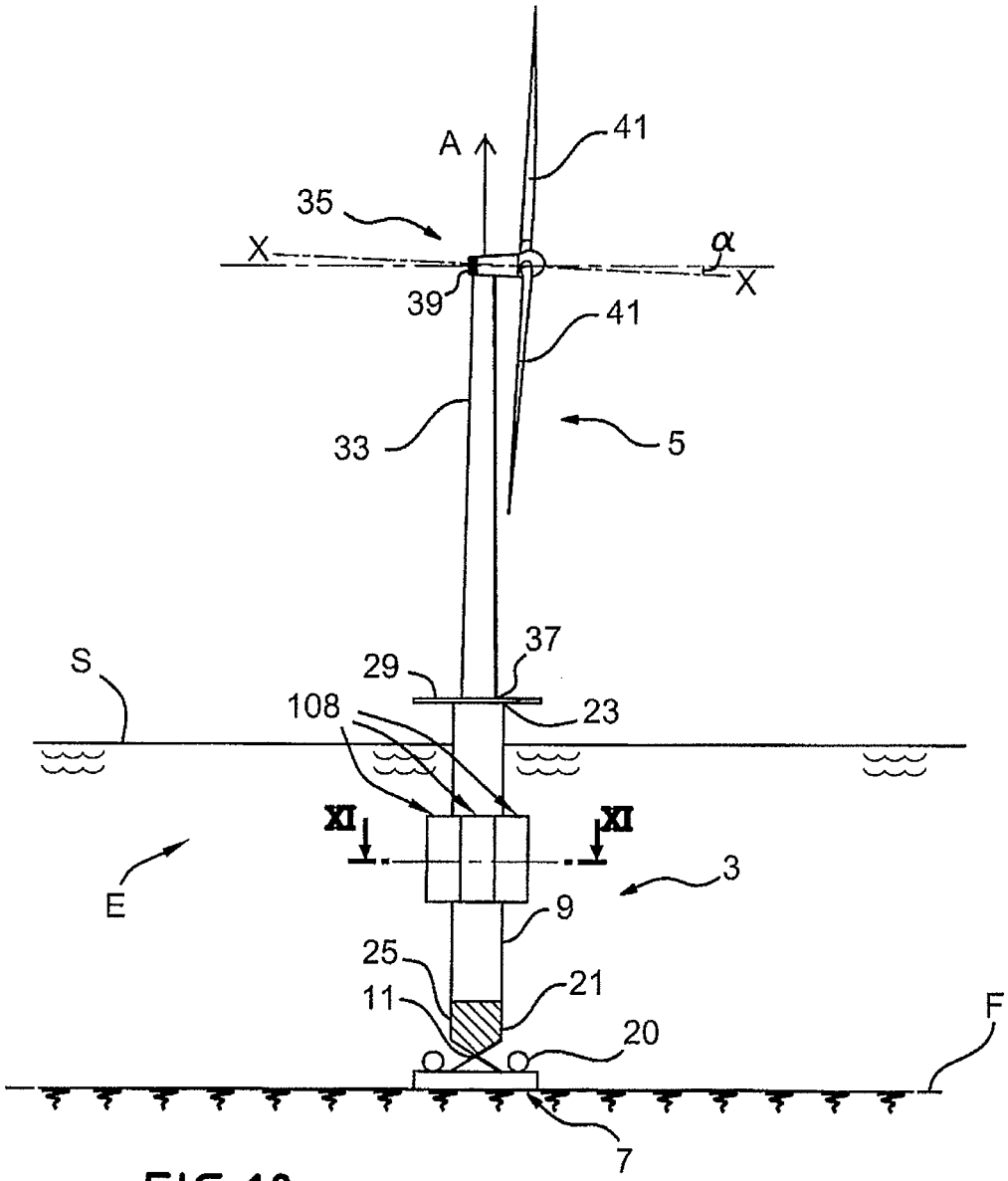
FIG. 10 is a side view of a wind energy convertor facility according to a third embodiment of the present invention.
Figure 11:
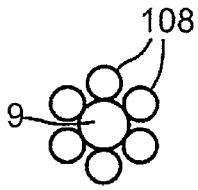
FIG. 11 is a cross-section along line XI-XI of FIG. 10.

In another method of construction, illustrated in FIGS. 10 and 11, the facility is fitted with buoyancy caissons 108, fixed around the column 9 near the surface S of water E, at an adjustable height. These caissons 108 can foster an improvement of the hydrodynamic behavior of the facility 1 regardless of the diameter of the column 9, and therefore, a minimized diameter, while facilitating the construction of the foundation support 3. The buoyancy of the facility 1 is adjusted, for example, by changing the position of the caissons 108 with respect to the sea surface, or even by changing their size. These caissons 108 can also substitute the compartments 27 of column 9.

Furthermore, the articulated joint between the column and the base is not necessarily of a universal joint type, but can consist of any means providing an articulated joint connection between the column and the base, which means allowing inclination motions of the column relatively to the base, in any direction with respect to its vertical axis.

As an alternative, the base is fixed on the seabed by means of suction anchor or driven piles.

Also, the horizontal axis of the turbine 39 can be offset from the true horizontal axis.

Other methods of construction and installation of the offshore wind power generator facility as per the invention can be envisaged.

In particular, as per another alternative, the foundation support is towed to the operation site. In this alternative, the foundation support is set vertically or inclined before being transported to the operation site, then towed into position.

According to another method, the wind energy convertor is fixed onto the support device before being transported to the operation site, thus avoiding the use of crane vessels at the operation site. In this method, the column top end can advantageously include a central recess, cylindrical or so, which is sized to house the lower part of the mast of the wind energy convertor. The mast is then inserted into the column in a sheltered site, and then raised by jacks after the facility has been installed at the operation site, which allows for improving the overall stability during transport to site.

It will be understood that the invention can be used with all types of wind energy convertors. It can be particularly advantageous to use a wind energy convertor that lowers the center of application of the wind force, such as a vertical axis wind turbine and/or a turbine that lowers the center of gravity of the facility, such as a turbine whose generator is placed on the platform 29 level or nearby.

In addition, the rotation axis X-X of the blades 41 can advantageously be preset at an angle inclined with respect to a horizontal axis when the column 9 is vertical. This presetting allows for limiting the deviation of the axis of rotation of the blades 41 relatively to its optimum operating angle when the column 9 tilts from the vertical.

The angle between the rotation axis of the blades 41 and the column can be adjustable as well, depending on the inclination of the column 9, so that the rotation axis of the blades 41 is close to horizontal, whatever the inclination of the column 9 is.

Modifications and improvements can be made to the embodiments described herein without departing from the scope of the present invention.

The invention claimed is:

1. An offshore wind power generator facility comprising a wind energy converter and a foundation support, the foundation support comprising a base and a buoyant column for supporting the wind energy converter, the column having a first end connected to the base, and a second end configured to fixedly mount the wind energy converter to the column aligned with a vertical axis of the column, wherein the wind energy converter comprises a mast and a system for producing electricity from wind energy, wherein the mast is fixed at its lower end to the second end of the column, wherein the column and the base are linked by an articulated joint connection, allowing tilt motions of the column relative to the base in all directions relative to the vertical axis due to forces exerted by ocean current, waves, and wind, and whereby the buoyancy of the column and hydrostatic forces resulting therefrom are sufficient to restore the column to be substantially parallel with the vertical axis without restraining forces due to mooring lines anchored to the seabed.

2. An offshore wind power generator facility according to claim 1, wherein the articulated joint connection comprises a universal joint.

3. An offshore wind power generator facility according to claim 2, wherein the universal joint is a cardan type.

4. An offshore wind power generator facility according to claim 1, wherein the column has an upper part and a lower part, and wherein the upper part has at least one watertight internal compartment.

5. An offshore wind power generator facility according to claim 4, wherein the column, in its upper part, has at least two watertight internal compartments.

6. An offshore wind power generator facility according to claim 5, wherein at least one of the internal compartments is partially immersed when the axis of the column is substantially aligned with the vertical axis.

7. An offshore wind power generator facility according to claim 1, wherein the column has an upper part and a lower part, and wherein the column presents in its upper part near a surface of the water, a cross section larger than in its lower part.

8. An offshore wind power generator facility according to claim 1, further comprising at least one buoyancy caisson attached to the column.

9. An offshore wind power generator facility according to claim 1, wherein the base is equipped with at least one buoyancy caisson which can be ballasted.

10. An offshore wind power generator facility according to claim 1, wherein the column comprises a steel lattice structure.

11. An offshore wind power generator facility according to claim 1, wherein the column comprises at its top end a recess which can house a lower part of the mast of the wind energy converter and allows a sliding motion of the mast inside the column.

12. A method for mounting an offshore wind energy converter comprising the steps of mounting a support base on a seabed;

mounting a buoyant support column through an articulated joint at a first end of the column to the base; and fixedly mounting a wind energy converter to a support column at a second end of the column, wherein the wind energy converter comprises a mast and a system for producing electricity from wind energy and wherein the mast is fixed to the second end of the column such that the mast is aligned with a vertical axis of the column, wherein the articulated joint allows for tilt motions of the column relative to the base in all directions relative to the vertical axis due to forces exerted by ocean current, waves, and wind, and whereby the buoyancy of the column and hydrostatic restoring forces resulting therefrom are sufficient to restore the column to be substantially parallel with the vertical axis without restraining forces due to mooring lines anchored to the seabed.

13. A method according to claim 12, wherein the articulated joint is a universal joint.

* * * * *

UNITED STATES PATENT AND TRADEMARK OFFICE

CERTIFICATE OF CORRECTION

PATENT NO. : 8,864,419 B2
APPLICATION NO. : 13/276214
DATED : October 21, 2014
INVENTOR(S) : Peter Broughton et al.

It is certified that error appears in the above-identified patent and that said Letters Patent is hereby corrected as shown below:

On the Title Page

(73) Assignees Insert -- Doris Engineering, Paris (FR) --

Signed and Sealed this
Eighteenth Day of August, 2015

Michelle K. Lee

Michelle K. Lee
*Director of the United States Patent and Trademark Office*